US007418797B1

(12) United States Patent
Crose

(10) Patent No.: US 7,418,797 B1
(45) Date of Patent: Sep. 2, 2008

(54) RECONFIGURABLE RIFLE STOCK SYSTEM

(76) Inventor: Charles R. Crose, 1606 Levern St., Clearwater, FL (US) 33757

( * ) Notice: Subject to any disclaimer, the term of this patent is extended or adjusted under 35 U.S.C. 154(b) by 353 days.

(21) Appl. No.: 11/110,030

(22) Filed: Apr. 20, 2005

(51) Int. Cl.
*F41C 23/04* (2006.01)
*F41C 23/14* (2006.01)

(52) U.S. Cl. ..... 42/74; 42/73; 42/71.01

(58) Field of Classification Search ..... 42/71.01, 42/71.02, 72, 73, 74, 75.01, 75.03, 75.1
See application file for complete search history.

(56) References Cited

U.S. PATENT DOCUMENTS 1,651,299 A * 11/1927 Stansel ..... 42/73
2,293,128 A * 8/1942 Fortin ..... 42/72
3,369,316 A * 2/1968 Miller ..... 42/72
4,055,016 A * 10/1977 Katsenes ..... 42/71.01
4,122,623 A * 10/1978 Stice ..... 42/73
4,299,046 A * 11/1981 Atchisson ..... 42/75.04
4,735,007 A * 4/1988 Gal ..... 42/72
4,766,800 A * 8/1988 Miller et al. ..... 89/33.02
4,896,446 A * 1/1990 Gregory ..... 42/73
5,209,215 A * 5/1993 Morrison ..... 124/25
5,410,833 A * 5/1995 Paterson ..... 42/73
6,598,329 B1 * 7/2003 Alexander ..... 42/71.01

* cited by examiner

*Primary Examiner*—Bret Hayes
(74) *Attorney, Agent, or Firm*—Edward P Dutkiewicz

(57) ABSTRACT

A shoulder support is fabricated of a light weight material. The shoulder support has a generally cylindrical front portion. The shoulder support has a connecting end and a rear portion. In this manner a generally triangular configuration is formed. The shoulder support has a central extent having a top end and a rear end with an intermediate portion. The rear portion has a concaved resting member. The resting member is adapted to rest against the front of a shoulder of a user. A coupling means is rotatable about a vertical axis and is adapted to couple the shoulder support to an end of a rifle.

3 Claims, 5 Drawing Sheets

FIG 1
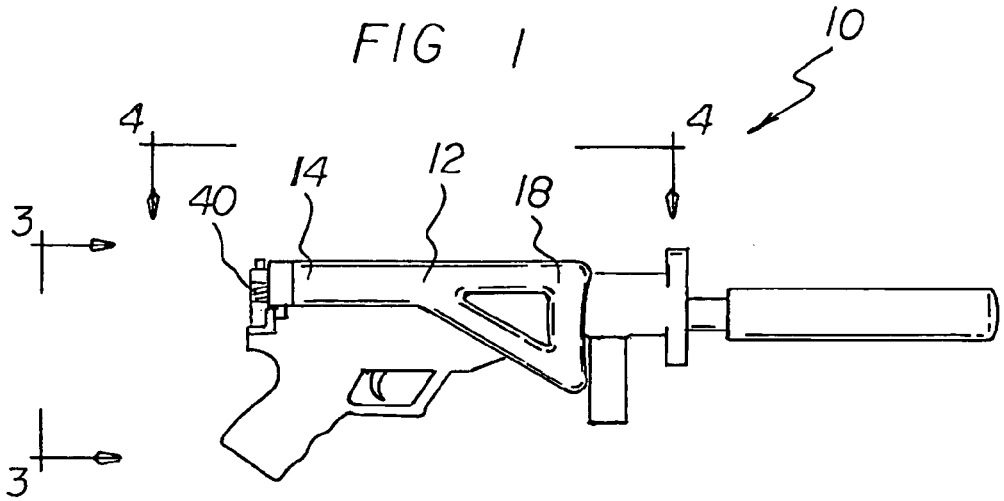
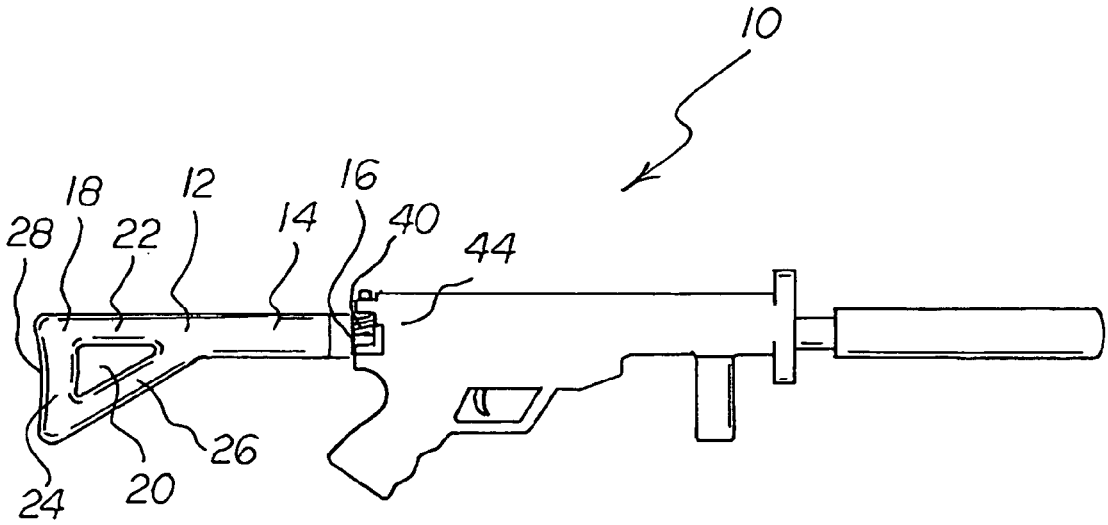
FIG 2

FIG 3
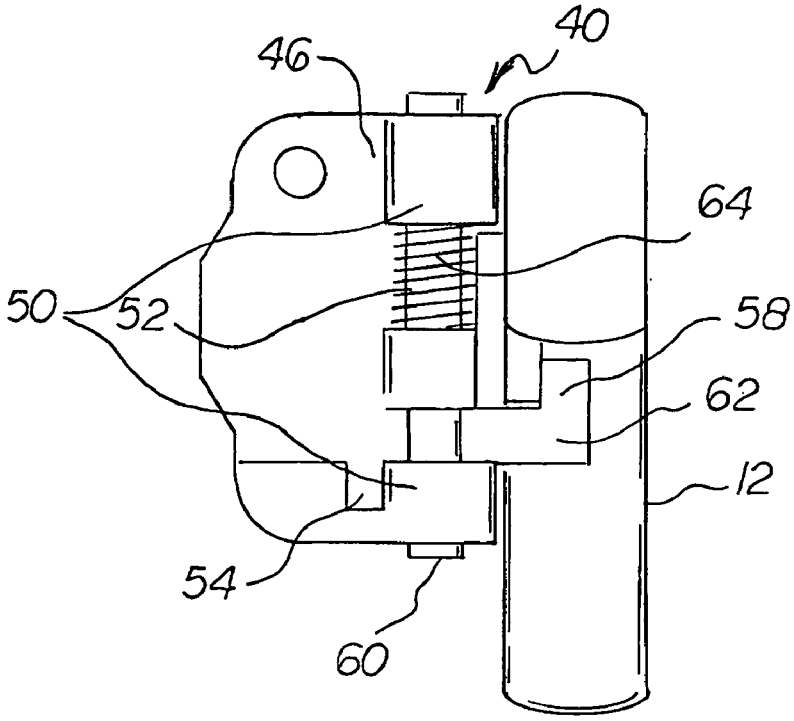
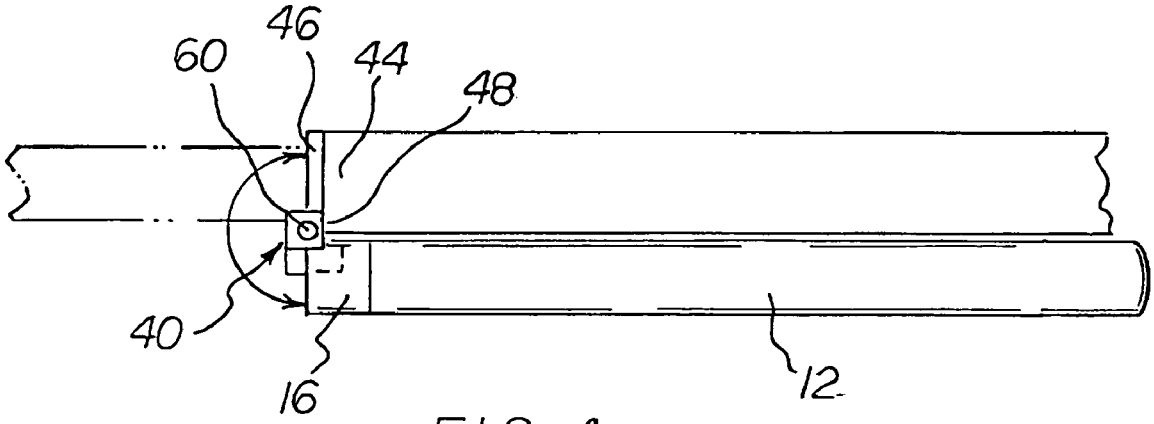
FIG 4

FIG 5
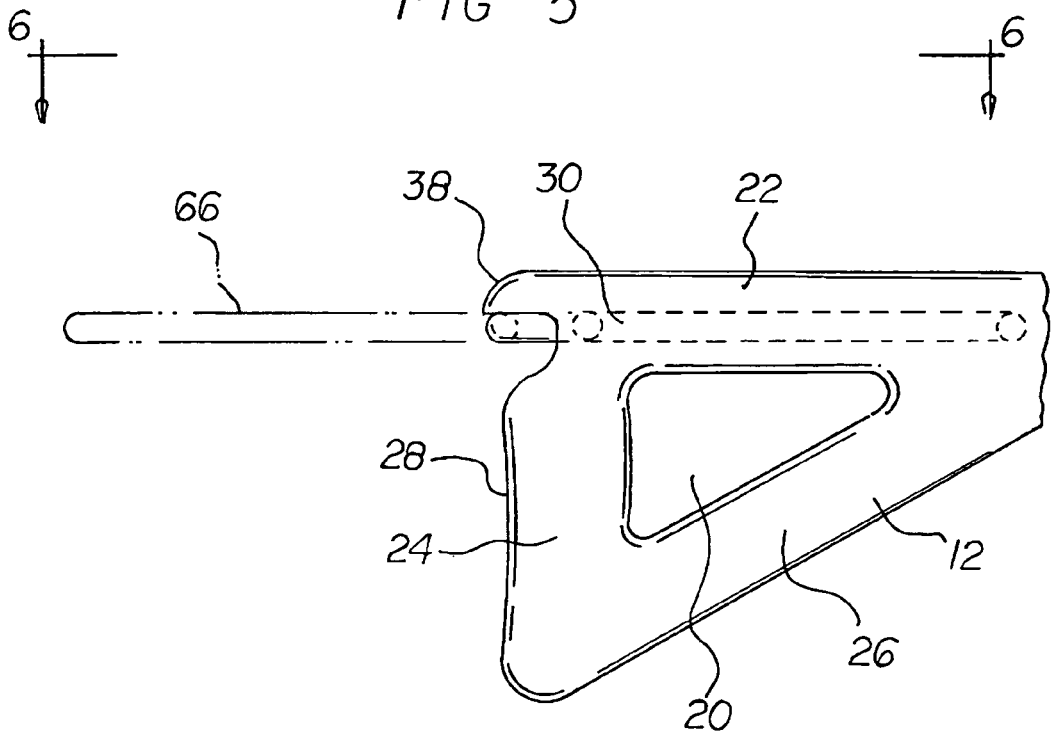
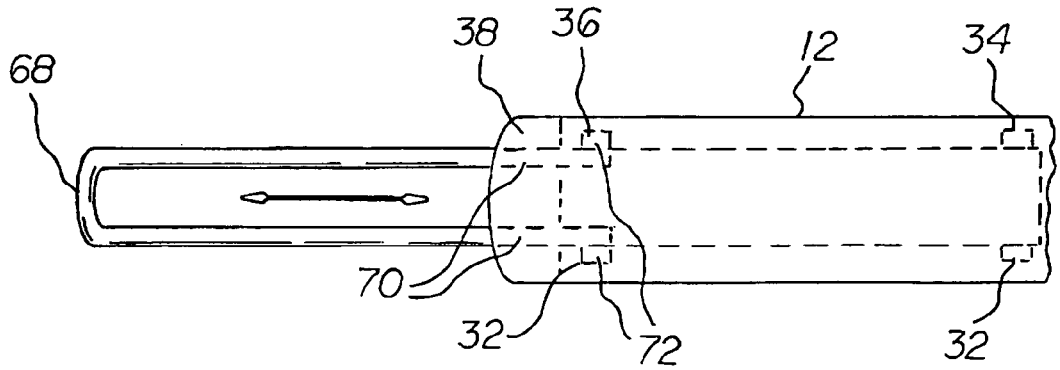
FIG 6

FIG 7
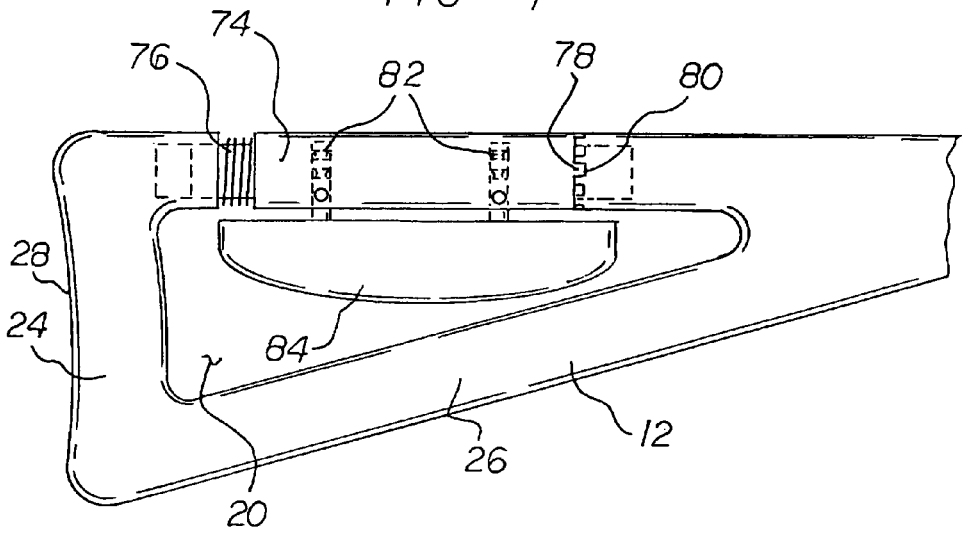
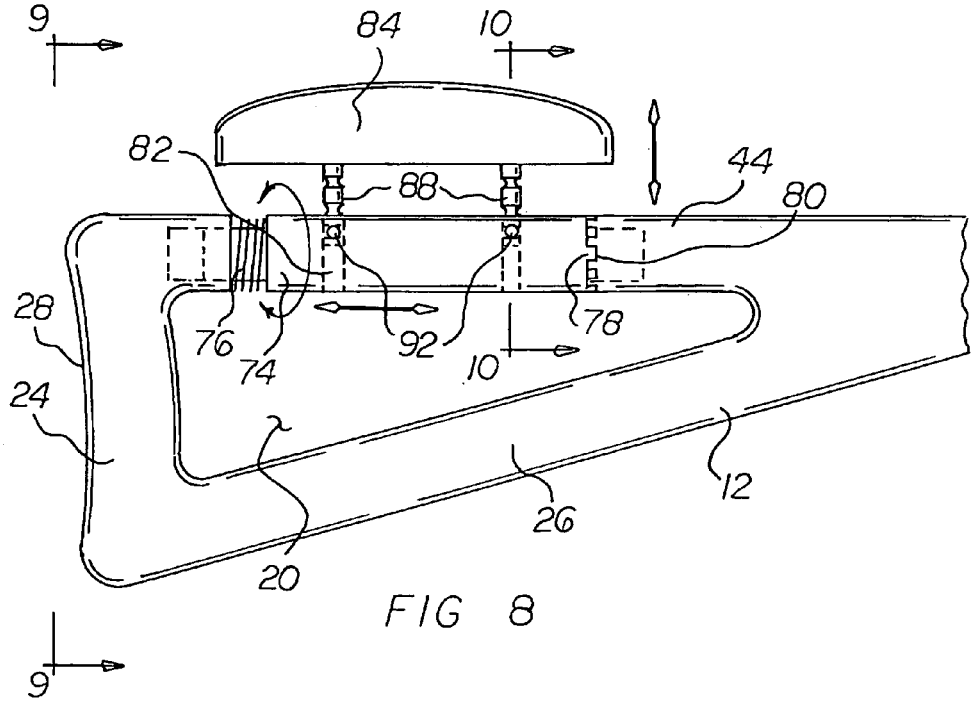
FIG 8

FIG 9
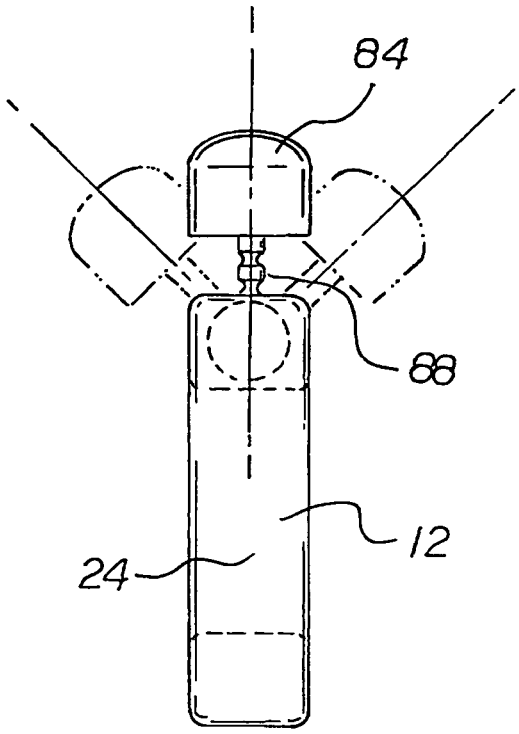
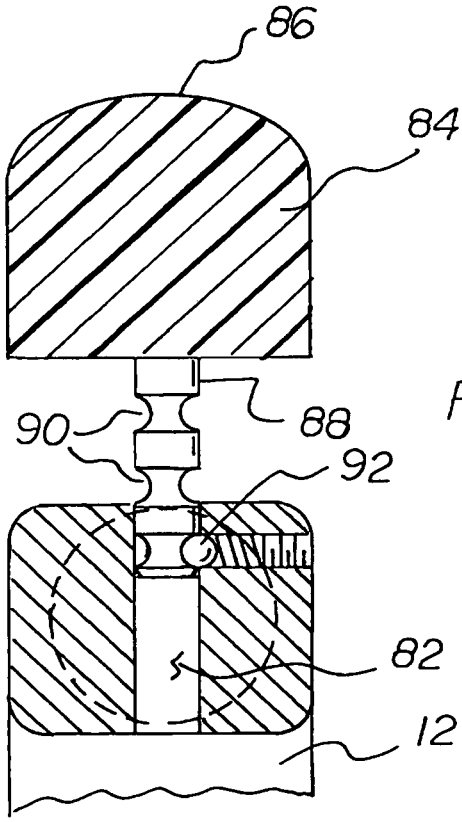
FIG 10

RECONFIGURABLE RIFLE STOCK SYSTEM

BACKGROUND OF THE INVENTION

1. Field of the Invention

The present invention relates to a reconfigurable rifle stock system and more particularly pertains to insuring stabilization during firing and compactness during storage.

2. Description of the Prior Art

The use of gun apparatuses of known designs and configurations is known in the prior art. More specifically, gun apparatuses of known designs and configurations previously devised and utilized for the purpose of stabilizing guns through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,970,642 to Martin discloses an ergonomic adjustable gun stock. U.S. Pat. No. 5,933,997 to Barrett discloses an adjustable comb apparatus. U.S. Pat. No. 4,896,446 to Gregory discloses a butt plate and comb assembly for shoulder firearms. U.S. Pat. No. 3,442,042 to Gilbert discloses a rotatable and slidable gunstock. Lastly, U.S. Pat. No. 3,369,316 to Miller discloses an apparatus for mounting and locking a folding stock on a rifle.

While these devices fulfill their respective, particular objectives and requirements, the aforementioned patents do not describe reconfigurable rifle stock system that allows insuring stabilization during firing and compactness during storage.

In this respect, the reconfigurable rifle stock system according to the present invention substantially departs from the conventional concepts and designs of the prior art, and in doing so provides an apparatus primarily developed for the purpose of insuring stabilization during firing and compactness during storage.

Therefore, it can be appreciated that there exists a continuing need for a new and improved reconfigurable rifle stock system which can be used for insuring stabilization during firing and compactness during storage. In this regard, the present invention substantially fulfills this need.

SUMMARY OF THE INVENTION

In view of the foregoing disadvantages inherent in the known types of gun apparatuses of known designs and configurations now present in the prior art, the present invention provides an improved reconfigurable rifle stock system. As such, the general purpose of the present invention, which will be described subsequently in greater detail, is to provide a new and improved reconfigurable rifle stock system and method which has all the advantages of the prior art and none of the disadvantages.

To attain this, the present invention essentially comprises a reconfigurable rifle stock system. First provided is a shoulder support. The shoulder support is formed of a resilient light weight material. The shoulder support has a generally cylindrical front portion. The shoulder support has a connecting end and a rear portion. In this manner a generally triangular configuration is formed. The shoulder support has an open central extent, a top end, a rear end and an intermediate portion. The rear portion has a concaved resting member. The resting member is adapted to rest against a front of a shoulder of a user. The top end of the shoulder support has a long linear opening. The long linear opening is provided along the major axis of the shoulder support. Two pairs of lateral apertures are provided at the linear opening. The apertures include an inner pair of apertures and an outer pair of apertures. The rear end also has a retainer lip.

Further provided is a coupling means. The coupling means is adapted to rotate about a vertical axis. First provided is a rifle. The coupling means couples the shoulder support to an end of the rifle. The coupling means has a first assembly. The rifle has a side edge. The first assembly is adapted to couple to the rear of a rifle adjacent to the side edge. A pair of coaxial hollow cylinders is provided. The cylinders have a central open region. The open region runs vertically adjacent to the side edge. The first assembly also has recess notches. The rifle has a central region. The recess notches are provided toward the central region of the rear of a rifle. The recess notches are provided adjacent to the coaxial hollow cylinders. The coupling means also has a second assembly. The second assembly is formed in the connecting end of the shoulder support. The second assembly also has a cylindrical pin. The cylindrical pin is adapted to reside within the coaxial hollow cylinder. The cylindrical pin has an L-shaped finger. The finger is fixed to a central portion of the pin. In this manner the finger resides in the central open region between the pair of coaxial cylinders. A retaining spring is provided. The retaining spring holds the finger in place.

The system also has a stored orientation. In the stored orientation, the shoulder support is rotated parallel to the body of the rifle. The system has an operative orientation. In the operative orientation the shoulder support is rotated in line with the body of the rifle. The shoulder support is adapted to rotate around the hinge. The hinge is formed between the coaxial cylinder and the pin. The shoulder support is further adapted to be locked into the operative orientation by the finger being retained in a recess notch of the first assembly.

Provided last is a horizontal support member. The horizontal support member has a generally U-shaped configuration. The horizontal support member has a curved central portion rearwardly. The horizontal support member also has a pair of free ends forwardly. The horizontal member is fabricated of a resilient metal that retains structural memory. The horizontal support member further has a pair of locking flanges. The locking flanges are coupled to the free end. The locking flanges are positioned laterally. The horizontal support member is adapted to slidably couple within the linear opening of the shoulder support. The horizontal support member is in the storage orientation when the flanges are locked in the inner pair of apertures. The horizontal support member is in the operative orientation when the flanges are locked in the outer pair of apertures. In this manner the horizontal support member is allowed to rest on the top of the shoulder of a user. The horizontal support member is held horizontally when upward pressure is applied thereon by the retainer lip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth, in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reconfigurable rifle stock system which has all of the advantages of the prior art gun apparatuses of known designs and configurations and none of the disadvantages.

It is another object of the present invention to provide a new and improved reconfigurable rifle stock system which may be easily and efficiently manufactured and marketed.

It is further object of the present invention to provide a new and improved reconfigurable rifle stock system which is of durable and reliable constructions.

An even further object of the present invention is to provide a new and improved reconfigurable rifle stock system which is susceptible of a low cost of manufacture with regard to both materials and labor, and which accordingly is then susceptible of low prices of sale to the consuming public, thereby making such reconfigurable rifle stock system economically available to the buying public.

Even still another object of the present invention is to provide a reconfigurable rifle stock system for insuring stabilization during firing and compactness during storage.

Lastly, it is an object of the present invention to provide a new and improved reconfigurable rifle stock system. A shoulder support is fabricated of a light weight material. The shoulder support has a generally cylindrical front portion. The shoulder support has a connecting end and a rear portion. In this manner a generally triangular configuration is formed. The shoulder support has a central extent having a top end and a rear end with an intermediate portion. The rear portion has a concaved resting member. The resting member is adapted to rest against the front of a shoulder of a user. A coupling means is rotatable about a vertical axis and is adapted to couple the shoulder support to an end of a rifle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the primary embodiment of the present invention in the stored position.

FIG. 2 is a perspective illustration of the primary embodiment of the present invention in the firing position.

FIG. 3 is an end view take along line 3-3 of FIG. 1 showing the coupling means of the present invention.

FIG. 4 is an elevational view taken along line 4-4 of FIG. 1 showing the coupling means of the present invention.

FIG. 5 is side elevational view of the present invention showing the horizontal support member.

FIG. 6 is an top view taken along line 6-6 of FIG. 5 showing the horizontal support member of the present invention.

FIG. 7 is perspective illustration of the cheek support of the present invention is the stored orientation.

FIG. 8 is perspective illustration of the cheek support of the present invention is the firing orientation.

FIG. 9 is end view of the present invention showing the various angles the cheek support can be set at and is taken along line 9-9 of FIG. 8.

FIG. 10 is cross sectional view of the cheek support and associated peg taken along line 10-10 of FIG. 8.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved reconfigurable rifle stock system embodying the principles and concepts of the present invention and generally designated by the reference numeral 10 will be described.

The present invention, the reconfigurable rifle stock system 10 is comprised of a plurality of components. Such components in their broadest context include a shoulder support and a coupling means. Such components are individually configured and correlated with respect to each other so as to attain the desired objective.

First provided is a shoulder support 12. The shoulder support is formed of a resilient light weight material. The shoulder support has a generally cylindrical front portion 14. The shoulder support has a connecting end 16 and a rear portion 18. In this manner a generally triangular configuration is formed. The shoulder support has an open central extent 20, a top end 22 and a rear end 24 with an intermediate portion 26. The rear portion has a concaved resting member 28. The resting member is adapted to rest against a front of a shoulder of a user. The top end of the shoulder support has a long linear opening 30. The long linear opening is provided along the major axis of the shoulder support. Two pairs of lateral apertures 32 are provided adjacent to the linear opening. The apertures include an inner pair of apertures 34 and an outer pair of apertures 36. The rear end also has a retainer lip 38.

Further provided is a coupling means 40. The coupling means is adapted to rotate about a vertical axis. A rifle is provided 44. The coupling means couples the shoulder support to an end of the rifle. The coupling means has a first assembly 46. The rifle has a side edge 48. The first assembly is adapted to couple to the rear of a rifle adjacent to the side edge. A pair of coaxial hollow cylinders 50 is provided. The cylinders have a central open region 52. The open region runs vertically adjacent to the side edge. The first assembly also has a recess notch 54. The rifle has a central region 56. The recess notch is provided toward the central region of the rear of a rifle. The recess notch is provided adjacent to the coaxial hollow cylinders. The coupling means also has a second assembly 58. The second assembly is formed in the connecting end of the shoulder support. The second assembly also has a cylindrical pin 60. The cylindrical pin is adapted to reside within the coaxial hollow cylinder. The cylindrical pin has an L-shaped finger 62. The finger is fixed to a central portion of the pin. In this manner the finger resides in the central open region between the pair of coaxial cylinders. A retaining spring 64 is provided. The retaining spring holds the finger in place.

The system also has a stored orientation. In the stored orientation, the shoulder support is rotated parallel to the body of the rifle. The system has an operative orientation. In the operative orientation the shoulder support is rotated in line with the body of the rifle. The shoulder support is adapted to rotate around the hinge. The hinge is formed between the coaxial cylinder and the pin. The shoulder support is further adapted to be locked into the operative orientation by the finger being retained in the recess notch of the first assembly.

Provided last is a horizontal support member 66. The horizontal support member has a generally U-shaped configuration. The horizontal support member has a curved central portion 68 rearwardly. The horizontal support member also has a pair of free ends 70 forwardly. The horizontal member is fabricated of a resilient metal that retains structural memory. The horizontal support member further has a pair of locking flanges 72. The locking flanges are coupled to the free end. The locking flanges are positioned laterally. The horizontal support member is adapted to slidably couple within the linear opening of the shoulder support. The horizontal support member is in the storage orientation when the flanges are locked in the inner pair of apertures. The horizontal support member is in the operative orientation when the flanges are locked in the outer pair of apertures. In this manner the horizontal support member is allowed to rest on the top of the shoulder of a user. The horizontal support member is held horizontally when upward pressure is applied thereon by the retainer lip.

In an alternate embodiment of the present invention the top end of the shoulder support has a central rotatable cylinder 74, an urging spring 76 and a plurality locking fingers 78 at a forward extent thereof. The shoulder support has associated notches 80. In this manner locking is allowed at various angles. The shoulder support further has a pair of parallel radial bore apertures 82. The apertures are provided within the central rotatable cylinder.

As may be seen in the embodiment of FIGS. 7 through 10, a cheek support 84 is provided. The cheek support has a convex upper portion 86 and a pair of support pegs 88. Each of the support pegs has a plurality of axially spaced annular recess 90 there around. The pegs are adapted to be received in the bore apertures of the rotatable cylinder. Spring urged bearings 92 are provided. The spring urged bearings lock the pegs in place by the bearings entering the annular recesses of the pegs. In this manner the user is allowed to adjust the cheek support angle around the rotatable cylinder. A storage position is provided within the open central extent of the shoulder support. The height of the cheek support is adjustable by moving the pegs with respect to the spring urged bearings.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reconfigurable rifle stock system comprising:

a shoulder support fabricated of a light weight material having a generally cylindrical front portion with a connecting end and a rear portion forming a generally triangular configuration with an open central extent, the shoulder support having a top end and a rear end with an intermediate portion, the rear portion having a concaved resting member adapted to rest against the front of a shoulder of a user;

a cheek support rotatably coupled to the shoulder support, the cheek support having a stored orientation being within the open central extent of the shoulder support and a deployed orientation being outside of the open central extent of the shoulder support; and a coupling means rotatable about a vertical axis and adapted to couple the shoulder support to an end of a rifle.

2. The system as set forth in claim 1 wherein the coupling means has a first assembly adapted to couple a rear of a rifle adjacent to a side edge and having a pair of coaxial hollow cylinders with the central open region running vertically adjacent to the side edge, the first assembly also having a recess notch toward a central region of a rear of the rifle and being adjacent to the coaxial hollow cylinders, the coupling means also having a second assembly formed in the connecting end of the shoulder support, the second assembly also having a cylindrical pin adapted to reside within the coaxial hollow cylinder and having an L-shaped finger fixed to a central portion of the pin such that the finger resides in the central open region between the pair of coaxial cylinders and held in place by a retaining spring, the system having a stored orientation where the shoulder support is rotated parallel to the body of the rifle, the system having an operative orientation where the shoulder support is rotated in line with the body of the rifle, the shoulder support being adapted to rotate around the hinge formed between the coaxial cylinder and the pin, the shoulder support is further adapted to be locked into the operative orientation by the finger being retained in the recess notch of the first assembly.

3. The reconfigurable rifle stock system as set forth in claim 1 wherein the top end of the shoulder support has a central rotatable cylinder, an urging spring and a plurality of locking fingers at a forward extent thereof and having associated notches to allow locking at various angles, the shoulder support further having a pair of parallel radial bore apertures within the central rotatable cylinder; and further including the cheek support having a convex upper portion and a pair of support pegs each having a plurality of axially spaced annular recess there around, the pegs being adapted to be received in the bore apertures of the rotatable cylinder with spring urged bearings locking the pegs in place by the bearings entering the annular recesses of the pegs, thereby allowing the user to adjust the cheek support angle around the rotatable cylinder including the storage position within the open central extent of the shoulder support and wherein the height of the cheek support is adjustable by the movement of the pegs with respect to the spring urged bearings.

* * * * *